US005146639A

United States Patent [19]

Krause

[11] Patent Number: 5,146,639

[45] Date of Patent: Sep. 15, 1992

[54] COMBINATION BATH, SHOWER AND BIDET SPOUT

[76] Inventor: Wilbur Krause, 9910-B N.E. 190th St., Bothell, Wash. 98011

[21] Appl. No.: 606,151

[22] Filed: Oct. 31, 1990

Related U.S. Application Data

[63] Continuation-in-part of Ser. No. 580,318, Sep. 10, 1990.

[51] Int. Cl.[5] ..... A47K 3/20; A47K 3/00

[52] U.S. Cl. ..... 4/567; 4/559; 4/568

[58] Field of Search ..... 4/559, 567, 568, 597, 4/601, 605, 596, 191, 192, 569, 570, 591, 546, 195, 615, 443, 444, 445, 446, 447, 448

[56] References Cited

U.S. PATENT DOCUMENTS

| | | | |
|---|---|---|---|
| 1,322,753 | 11/1919 | Blair | 4/192 |
| 2,011,446 | 8/1935 | Judell | 4/192 |
| 2,024,930 | 12/1935 | Judell | 4/192 |
| 3,121,235 | 2/1964 | Gellmann | 4/570 |
| 3,182,336 | 5/1965 | Greuter | 4/570 |
| 3,717,142 | 2/1973 | Mickelson | 4/559 |
| 3,880,183 | 4/1975 | Humpert et al. | 4/192 |
| 4,293,523 | 7/1983 | Nolden | 4/192 |

*Primary Examiner*—Henry J. Recla
*Assistant Examiner*—David J. Walczak
*Attorney, Agent, or Firm*—Russell W. Illich

[57] ABSTRACT

A combination bath tub spout is provided for allowing three distinct water flow paths to achieve three different functions. The first path allows the spout to fill a bath tub. The second path diverts the flow of water to a shower head. The third path directs the flow of water to an upwardly directed nozzle at the end of the spout. The nozzle can be used as a bidet spray for washing a person's genitals, or alternatively be used in conjunction with a douche hose attachment as an effective method of douching for women. The three paths are achieved by a rotatable diverter or valve that rotates between three predetermined positions; a bath tub fill position, a shower diverted position, and an upwardly directed nozzle position.

6 Claims, 6 Drawing Sheets

COMBINATION BATH, SHOWER AND BIDET SPOUT

CROSS REFERENCES TO RELATED APPLICATIONS

This is a continuation-in-part of application Ser. No. 580,318, filed Sep. 10, 1990.

BACKGROUND OF THE INVENTION

The present invention relates to a bath tub spout, and more specifically to shower diverted spouts. In the past, bath tub spouts were primarily used to fill bath tubs, but eventually these spouts were built with valves to divert the water to a shower head. Most of these spouts have vertical sliding gates with handles that are pulled up, to lift the gate past the tub filling passage, and force the water up to the shower head.

Although spouts manufactured with this construction, function as intended, they generally fail to divert all of the water to the shower head due to leakage past the diverter valve. This results in significant waste of hot water. Furthermore, these spouts are limited in their uses. Basically, conventional spouts merely fill the bathtub or divert the water to the shower head. The spouts fail to be adaptable to other types of uses.

One use that is particularly convenient is to have a bidet spray situated within the bathtub. Such sprays within a bathtub are generally far less messy than sprays within a separate toilet bowl. There are a number of patents within the field of bath fixtures directed to a lower body spray.

U.S. Pat. No. 4,123,808 to Guarrera relates to a bidet spray and hose that are connected to a shower outlet once the shower head is removed from the outlet. Although, this fixture serves its intended purpose, the device is highly impractical, because a person must reconnect the shower head or bidet spray unit every time he/she wishes to use the bidet spray or shower, respectively.

U.S. Pat. No. 3,858,252 to Ejchorszt relates to a retrofit shower head assembly that includes a coventional head-level shower head and a lower spray unit. This device really isn't directed to providing a bidet spray within a shower or tub, because the spray comes out horizontally from the elongated shower assembly. Bidet sprays need to be directed upward toward a person's genitals in order to work most effectively.

U.S. Pat. No. 3,375,532 to Gellmann relates to a shower head attachment that can additionally divert the water to a lower spray head that may be used as a bidet spray. Although Gellmann's device allows a person to use the bath spout, shower, or bidet spray, it has many disadvantages in everyday use. First, the entire attachment device is expensive because it requires the purchase of two special spray heads, additional pipe, and an extra diverter valve. It cannot be used with conventional shower heads because it requires a special fitting for the lower spray head. Second, the device must be attached to the wall at two points and its installation is complicated. Third, the device is ungainly with its exterior design. Aesthetically, most people wish to have all plumbing behind the bathroom walls with only the tub fixtures and shower head extending out of the wall. Finally, the device has a complicated water diversion process requiring a person to operate both faucets and three diversion valves to get the water through the right spray head or bath spout, at the right temperature and pressure. Most people simply don't have the patience for fine tuning the water supply through one of Gellmann's three fixtures.

There has been a need within the field of bath fixtures for an improved bath spout that has an effective shower diverter, and has additional uses, as well.

SUMMARY OF THE INVENTION

It is an object of this invention to provide a device that includes an improved diverter assembly on a bath tub spout allowing water to be diverted to the shower without any leaking.

Another object of the invention is to provide a device with a bidet spray or nozzle to be used within the bathtub and means for attaching a douche hose to the nozzle.

It is a further object of the invention to provide a device that is easy to install on existing tubs, inexpensive to manufacture, and aesthetically pleasing to use.

Other objects of the invention will be apparent hereinafter from the specification and from the recital of the appended claims, particularly when read in conjunction with the accompanying drawings.

The present invention comprises a bath tub spout that utilizes a rotating head which rotates between three distinct positions to achieve three different functions. The first position is a bath fill position that allows the tub to be filled with water coming through the spout. The second position is a shower diversion position that blocks all water from coming through the spout and effectively diverts all water to the shower head. The third position is a bidet spray position that allows water through the tub spout and directs the water at an upward angle toward a person's genitals.

The rotating head acts as both a spout in the first and third positions, and a diverter valve in the second position. Thus, it is very easy to use, requiring only a single motion. The spout can easily replace existing bath tub spouts through a threaded attachment at one end of the spout opening.

The bidet spray can be adjusted for temperature and pressure by using the existing temperature control faucets for hot and cold. The bidet spray will also accomodate a douche hose that may be attached to the end of the bidet nozzle. The douche hose feature provides a sanitary time saving and convenient device.

DETAILED DESCRIPTION OF THE INVENTION

Figure 1:
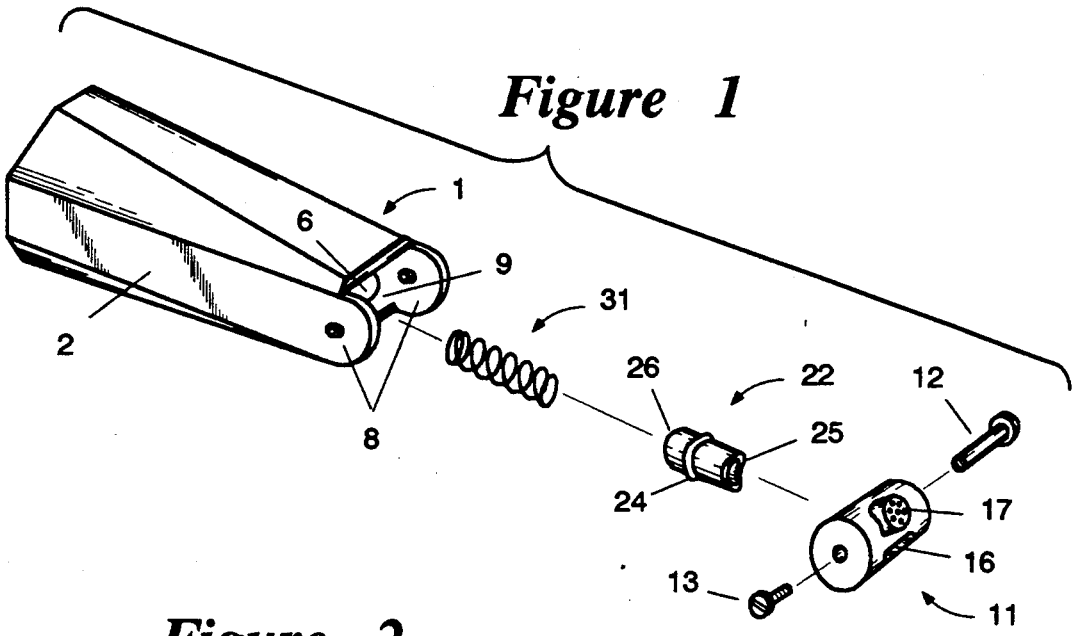
FIG. 1 shows an exploded perspective view of a first embodiment of the combination spout of the present invention.
Figure 2:
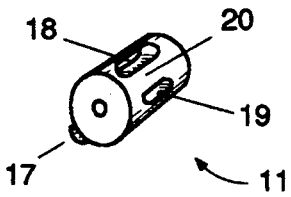
FIG. 2 shows an opposite perspective view of the rotating head from the one shown in FIG. 1.
Figure 3:
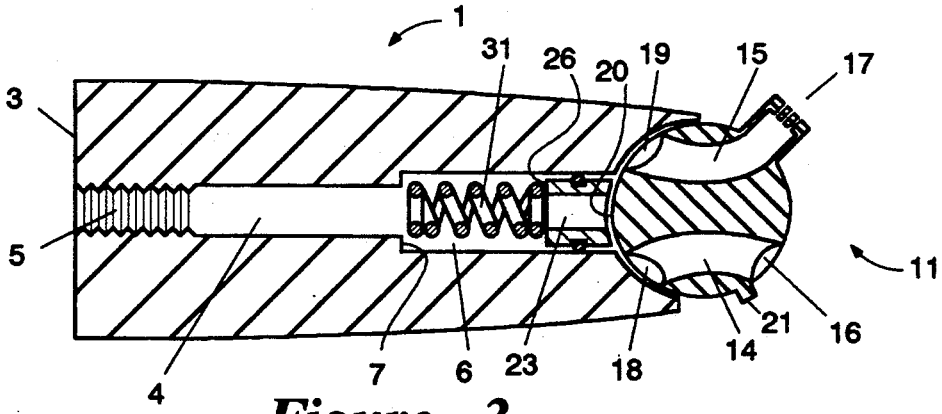
FIG. 3 shows a longitudinal cross section of the combination spout of FIG. 1 in its shower diverted position.

FIGS. 1–3 show a preferred embodiment of the combination spout of the present invention. The spout 1 includes an outer body 2 with a flat end face 3, as best seen in FIG. 3. Extending longitudinally through the body 2 is an axial bore 4 having internal threads 5 at the end of the spout adjacent the end face 3. The bore 4 widens to an expanded bore 6 which opens out at the end of the spout, as best seen in FIG. 1. Between bores 4 and 6 is a shoulder 7 which provides a bearing surface for spring 31.

At the front of the spout 1 are two mounting flanges 8 which extend on either side of the spout. A semi-circular curved surface 9 is provided between the flanges 8 through which the expanded bore 6 extends. The semi-circular shape of surface 9 can best be seen in FIG. 3 where the surface 9 is not enumerated for clarity reasons.

A rotatable head 11 is generally shaped as a cylinder which rotates between three positions upon the axis of the cylinder. The head 11 is mounted to the flanges 8 of spout 1 by an internally threaded post 12 which mates with screw 13. The post 12 acts as an axle on which the head rotates relative to the spout. FIG. 3 shows the inner details of the head 11. A pair of arcuate shaped channels 14 and 15 correspond to a bath tub fill conduit and a bidet spray conduit, respectively. The channel 14 includes an outlet 16 to allow water to flow out of the spout and fill the bath tub. Channel 15 includes an outlet 17 shaped as an upwardly angled nipple with small holes within its top surface to allow water to release upwardly from the spout and form a bidet-type spray. Channels 14 and 15 further include inlets 18 and 19, respectively, to allow water to enter the head 11 from the expanded bore 6 and exit through one of the two outlets 16 or 17. A bearing surface 20 extends between the two channels and acts as a block or gate to divert water from the spout 1 to the shower head by blocking the passage 6 from the rotatable head 11, as shown in FIG. 3. A stop 21 is shown below the tub outlet 16 as a cubic shaped projection that positions the rotatable head 11 at a predetermined bath tub fill position.

Channel 15 is of a more narrow construction than channel 14. This allows the bidet spray to exit the outlet 17 under a greater pressure than the normal tub outlet 16. The higher pressure is needed to produce a more effective bidet spray. FIG. 2 shows more details of the rotatable head 11. The oblong shaped bidet spray inlet 19 is shown of a smaller dimension than the tub fill inlet 18 to produce the higher pressure needed within the bidet channel 15. Bearing surface 20 is disposed between the two inlets to provide the gate needed to divert the water to the shower head (not shown).

An open cylindrically shaped bearing member 22 is disposed within the expanded bore 6. The bearing member includes an axial bore 23 extending through the center of the cylinder and a circumferential groove (not numbered) to seat an O-ring 24. The O-ring acts to seal and position the bearing member within bore 6 of the spout. The front of the bearing member includes a concave arcuate surface 25 to mate with the outer peripheral surface of rotatable head 11. The mating of the outer peripheral surface of the head and the concave arcuate surface 25 is best seen in cross-section in FIG. 3. An end surface 26 of the bearing member 22 acts as a bearing surface for one end of spring 31. The other end of spring 31 bears against shoulder 7 of the spout 1, as previously explained. The spring biases bearing member 22 toward the head 11 to provide a sealed connection between the spout 1 and head 11.

FIG. 3 shows a gap between the head 11 and bearing surfaces 25 and 9 on the bearing member 22 and spout 1, respectively. This gap is depicted for clarity reasons, only. In actual manufacture, the tolerances between the head, bearing member, and spout would be much more exact, than shown, to provide a tightly sealed system and prevent any leaks from occurring between any one of the three positions of the head 11.

Figure 4:
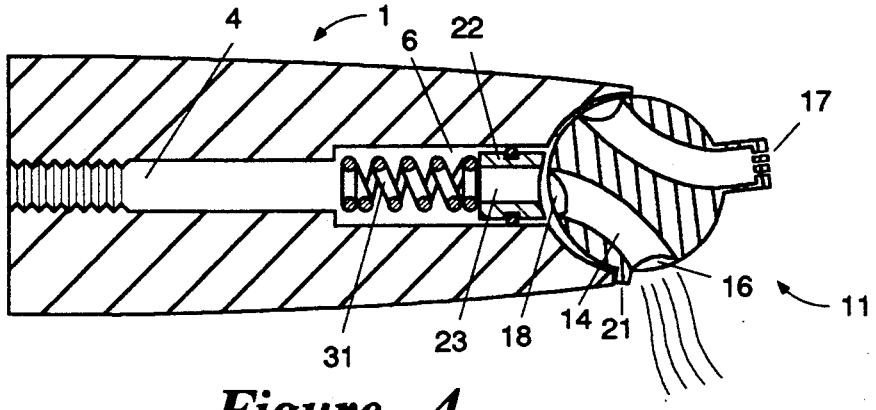
FIG. 4 shows a longitudinal cross section of the combination spout of FIG. 1 in its bath fill position.
Figure 5:
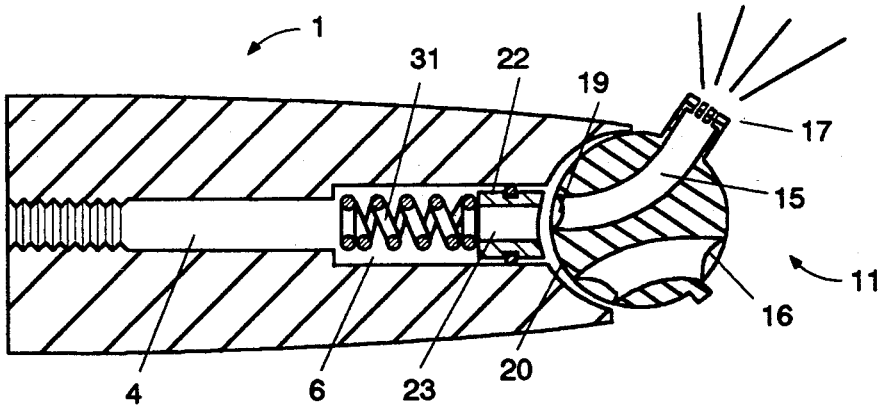
FIG. 5 shows a longitudinal cross section of the combination spout of FIG. 1 in its bidet spray position.

The three positions of the head 11 are successively depicted in FIGS. 3, 4, and 5. FIG. 3 shows the spout in its shower diverted position. The tight tolerance between bearing surface 20 and bearing surfaces 9 and 25 yield a diverter that is far more effective than conventional shower diverters with vertically sliding gates. As explained previously, vertically sliding gate diverters tend to leak some water through the bath tub spout. Some leaks can develop into profuse leaks that waste significant amounts of hot water. The diverted position of the present invention, shown in FIG. 3, solves this problem with a tightly sealed system that forces all water to back up into the shower head (not shown).

FIG. 4 shows the head 11 in its bath tub fill position. In this position, the head 11 is rotated downwardly such that outlet 16 faces down toward the bottom of the bath tub. Channel 14 is connected to bore 4 by having inlet 18 aligned with opening 23 of the bearing member. In this position water is able to freely flow through bores 4, 6, 23, and 14 to exit out the bath tub outlet 16.

FIG. 5 shows the head 11 in its bidet spray position. In this position, the head 11 is rotated by the person until the nozzle 17 is positioned at the desired angle. At this point, the narrow bidet inlet 19 is aligned with opening 23 in bearing member 22 to allow a constricted flow of water to flow out of bores 4, 6, 23, and 15 to exit out the bidet spray outlet 17. The water exits out the fine holes in the end surface of the nipple 17 at a high pressure to form a fine bidet spray for washing and rinsing a person's genital areas.

The spout can further act as a convenient manner of douching. Basically, a douch hose can be attached to the end of the nipple 17. The nipple could be made removable with a compartment to allow powder to be poured into the nipple, to aide in use of the spout as a method of douching.

The installation of the combination spout of the present invention is very easy. A person prepares the bath tub for the combination spout by unscrewing their existing spout from the bath tub inlet pipe. The person then installs the combination spout by screwing the internal threads 5 of the spout onto the external threads of the bath tub inlet pipe. Occasionaly, a shim is needed between the end face 3 of the spout and the bathroom wall so that the spout lies flush against the surface of the wall. No complicated plumbing is necessary to install the combination spout of the present invention. The device uses all of the existing pipes, faucets, etc. within a conventional bath tub.

The construction of the combination spout would be of conventional materials such as metals, plastics, etc. The exterior parts of the spout can be made of aesthetically pleasing materials or coatings such as stainless steel. The interior parts of the spout including the spring 31, bearing member 22, and rotatable head 11 would require non-corrosive surfaces since water would flow regularly past these parts.

FIGS. 6–9 show a second form of the combination spout of the present invention. In this embodiment of the invention, a cylindrically-shaped hood 51 pivots on the end of a bath tub spout 41 to three distinct positions corresponding to the bath fill, shower diverted, and bidet spray positions. The spout 41 includes a body 42 with a flared back end 43 and has internal threads positioned approximately within the center of body 42. The flared back end is made specifically for older bath tub spouts that cover external plumbing parts extending outside of the bathroom wall. In this case, the bath tub fill pipe (not shown) extends 2–3 inches from the wall and has external threads to mate with the internal threads 44 of the spout 41. The threads 44 lead into the central water passage 45 that leads to the fixed, cylindrically-shaped spout end 46. The spout end provides a bearing for the pivotable hood 51. The spout end further includes a bath tub fill opening 47 and a bidet spray opening 48. Within opening 48, is a screen 49 with small holes to form a fine bidet spray when the water is diverted through opening 48.

Figure 6:
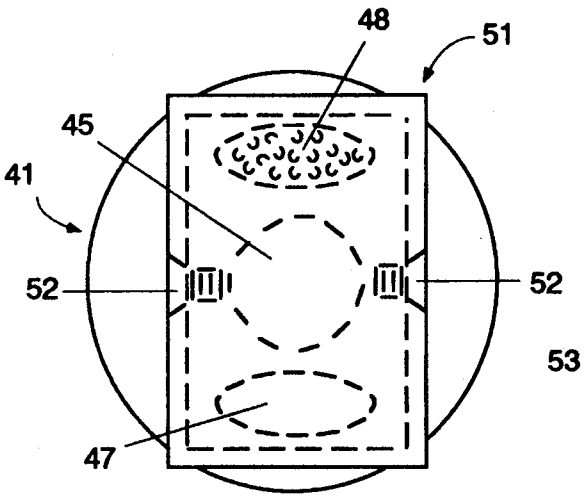
FIG. 6 shows an end plan view of a second embodiment of the combination spout of the present invention.

The hood 51 is rotatably fastened to the spout end 46 by screws 52 at opposite sides of the spout end, as best seen in FIG. 6. The hood includes a handle 53 extending from a semi-circular bearing surface 54 which slides upon the cylindrically-shaped spout end 46. The hood further includes a curved back end 55 that defines the position of the hood in the plan views of FIGS. 7–9.

Figure 7:
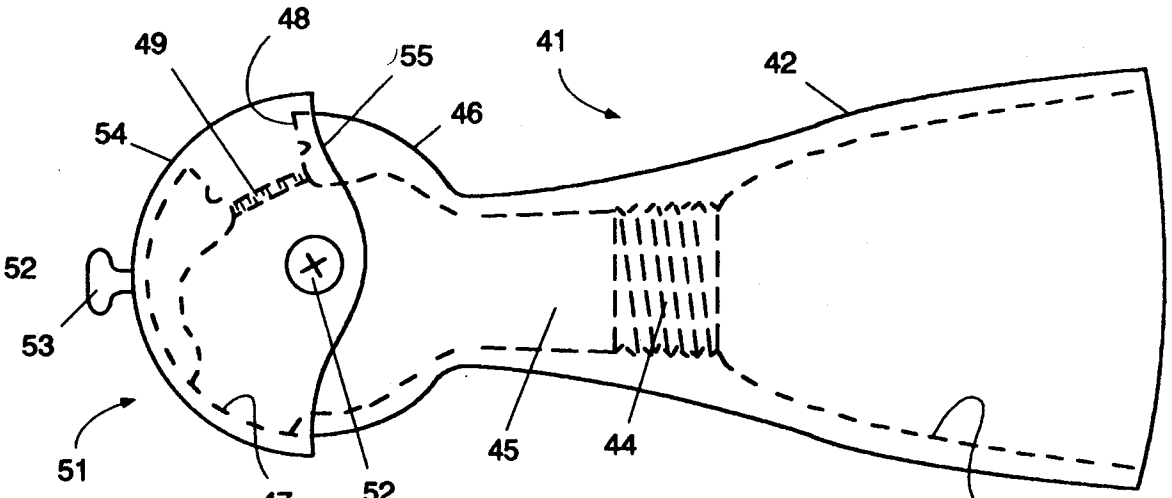
FIG. 7 shows a side plan view of the combination spout of FIG. 6 in its shower diverted position.
Figure 8:
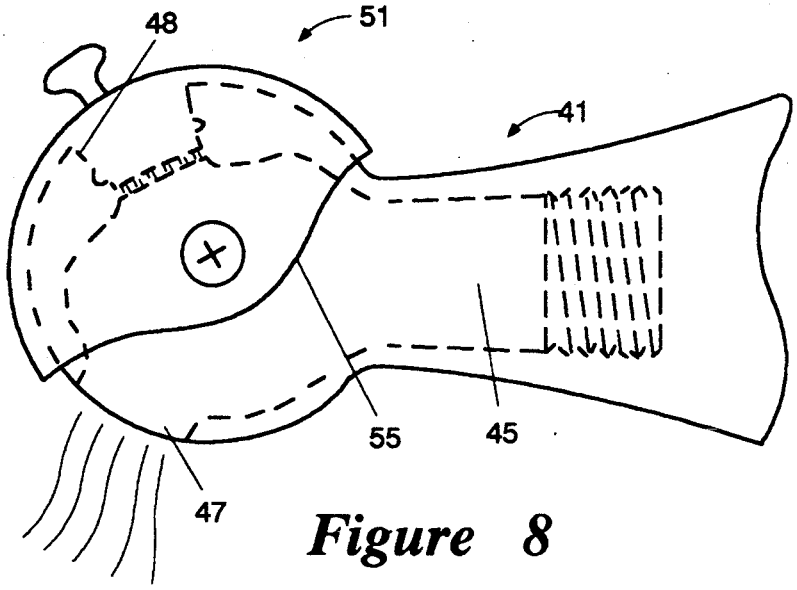
FIG. 8 shows a side plan view of the combination spout of FIG. 6 in its bath fill position.
Figure 9:
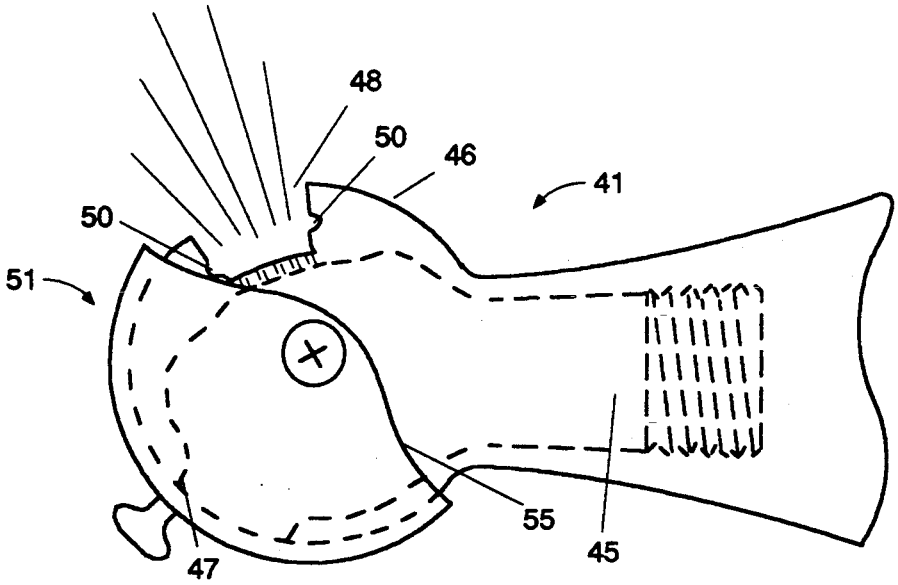
FIG. 9 shows a side plan view of the combination spout of FIG. 6 in its bidet spray position.

In operation, FIGS. 7, 8 and 9 represent the shower diverted, bath tub fill, and bidet spray positions of the combination spout, respectively. When the hood 51 is in the position of FIG. 7, the bearing surface 54 covers both the bath tub fill opening 47 and the bidet spray opening 48. Tight tolerances are formed between the spout 41 and the hood 51 to ensure no leaks occur out of either opening 47 or 48 when in the shower diverted position. In this position, the hood becomes a blocking screen for the spout which subsequently diverts all water to the shower head (not shown).

When the hood 51 is rotated upwardly, as in FIG. 8, water may freely flow through the central water passage 45 and out the bath tub fill opening 47. The curved edge 55 acts as a gate to allow the water to flow out opening 47, and acts as a stop at its top to prevent the hood from being rotated too far. In the position of FIG. 8, the bidet spray opening 48 continues to be blocked and water cannot flow out this opening.

When the hood 51 is rotated downwardly, as in FIG. 9, water may freely flow through the central water passage 45 and out the bidet spray opening 48. In this position, the tub fill opening 47 is blocked by the hood 51 and all water is diverted to the bidet spray opening 48. Again, the curved edge 55 acts as a gate to allow the water to flow out opening 48, and acts as a stop at its bottom to prevent the hood from being rotated too far. Opening 48 is narrower than opening 47, to constrict the passage 45 and cause the water to issue from opening 48. The constricted opening forms a better bidet spray from water under higher pressure. Opening 48 further includes recesses 50 into which an optional douche hose can be connected. The purpose and function of the douche hose is substantially the same as described above for the first embodiment.

The embodiment of FIGS. 6–9 functions very similarly to the first embodiment with all of the intendant advantages including ease-of-installation, ease-of-use, and convenience of having a bidet spray and optional douche hose.

FIGS. 10–13 show a third form of the combination spout of the present invention. In this embodiment of the invention, a hemi-spherical hood 71 rotates upon the end of a bath fill spout 61 to the three distinct positions: bath fill, shower diverted, and bidet spray. The spout 61 includes a chalice-shaped body 62 with a flat end face 63 from which internal threads 64 extend. A main water passage 65 extends from the threads 64 to the hemi-spherical front end 66 of the spout. The front end of the spout provides a bearing for the rotatable hood 71. The spout end further includes a bath tub fill opening 67 and a bidet spray opening 68.

Figure 10:
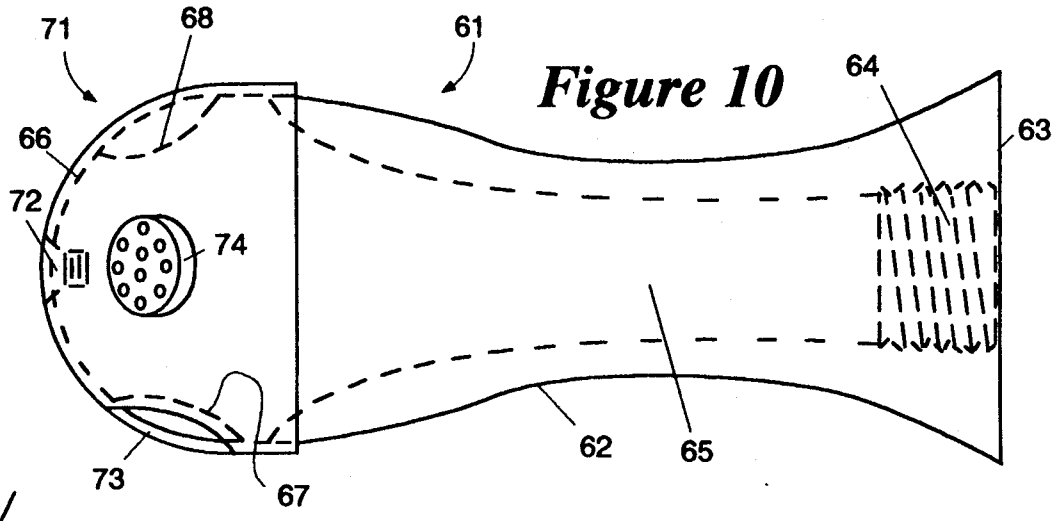
FIG. 10 shows a side plan view of a third embodiment of the combination spout of the present invention.

The hood 71 is rotatably fastened to the spout end 66 by screw 72 at the center of the hood, as best seen in FIG. 10. The hood includes a bath tub fill opening 73 that corresponds in size to spout end opening 67. The hood also includes a bidet spray nipple with a plurality of holes to produce a bidet-type spray when aligned with opening 68 of the spout end.

Figure 11:
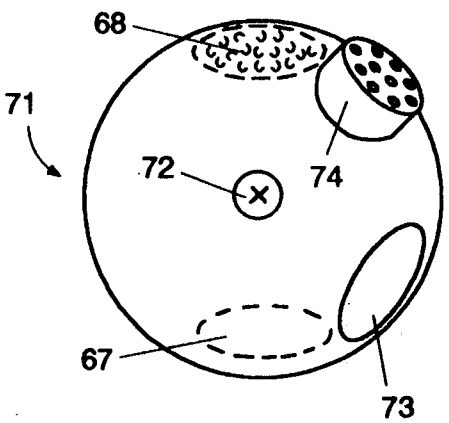
FIG. 11 shows an end plan view of the combination spout of FIG. 10 in its shower diverted position.
Figure 12:
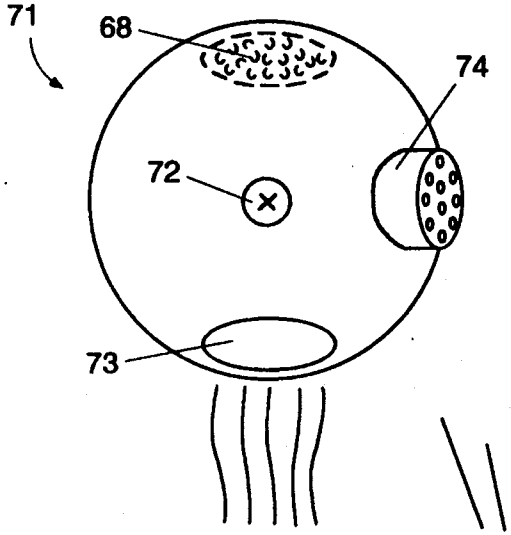
FIG. 12 shows an end plan view of the combination spout of FIG. 10 in its bath fill position.
Figure 13:
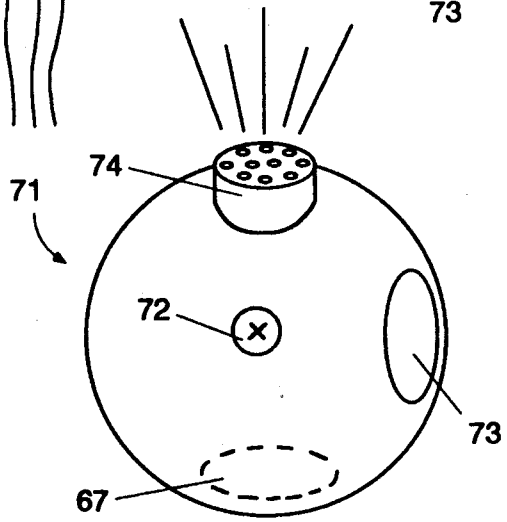
FIG. 13 shows an end plan view of the combination spout of FIG. 10 in its bidet spray position.
Figure 14:
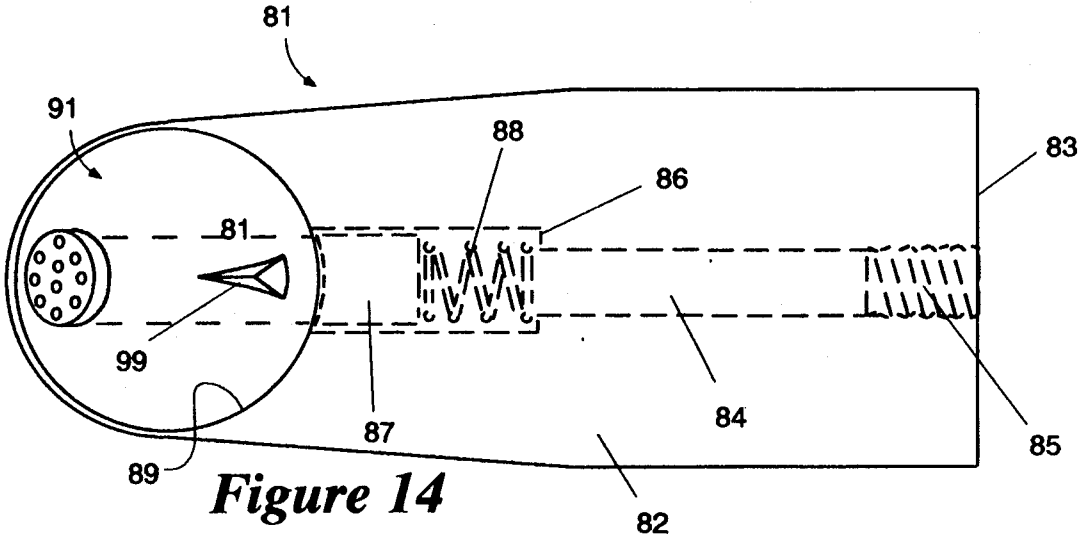
FIGS. 14–17 show a top plan view and three side plan views depicting three different positions of a fourth embodiment of a combination spout of the present invention.

In operation, FIGS. 11, 12 and 13 represent the shower diverted, bath tub fill, and bidet spray positions of the combination spout, respectively. When the hood 71 is in the position of FIG. 11, the hood covers both the bath tub fill opening 67 and the bidet spray opening 68. Again, tight tolerances are formed between the spout 61 and the hood 71 to ensure no leaks occur out of either opening when in the shower diverted position. In this position, the hood becomes a blocking screen for the spout which subsequently diverts all water to the shower head (not shown).

When the hood 71 is rotated to the right, as in FIG. 12, water may freely flow through the central water passage 65 and out the bath tub fill opening 67. In the position of FIG. 12, the bidet spray opening 68 continues to be blocked and water cannot flow out this opening.

When the hood 71 is rotated to the left, as in FIG. 13, water may freely flow through the central water passage 65 and out the bidet spray nipple 74. In this position, the tub fill opening 67 is blocked by the hood 71 and all water is diverted to the bidet spray opening 68, 74. Opening 68 is narrower than opening 67, to constrict the passage 65 an cause the water to issue from opening 68 under higher pressure. Nipple 74 can also be used to attach a douche hose to the spout, as in the embodiment of FIGS. 1–5. The purpose and function of the douche hose is substantially the same as described above for the first embodiment. Additionally, powder can be added within the space between opening 68 and the hood when the hood is rotated to align hood opening 73 with spout opening 68. Then when the hood is turned to the position of FIG. 13, the powder can be ejected with the water to form a more effective douche.

FIGS. 14–17 show a fourth form of the combination spout of the present invention. The spout 81 of this embodiment of the invention is similar to the spout of the first embodiment of the invention of FIGS. 1–5. Specifically, it includes an elongated body 82 with a flat end face 83 and a bore 84 through the center of the body. The bore 84 includes internal threads 85 adjacent the flat face and a widened bore for accommodating a bearing member 87 at the opposite end of bore 84. Between the ends of bore 84 is a shoulder 86 which provides a surface against which a spring 88 biases the bearing member toward a rotatable head 91. At the forward end of spout 81 is a large vertical hole 86 to support the rotatable head.

Figure 16:
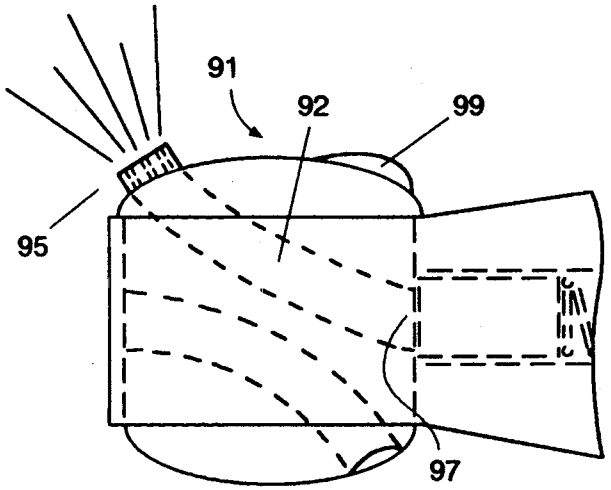
Figure 17:
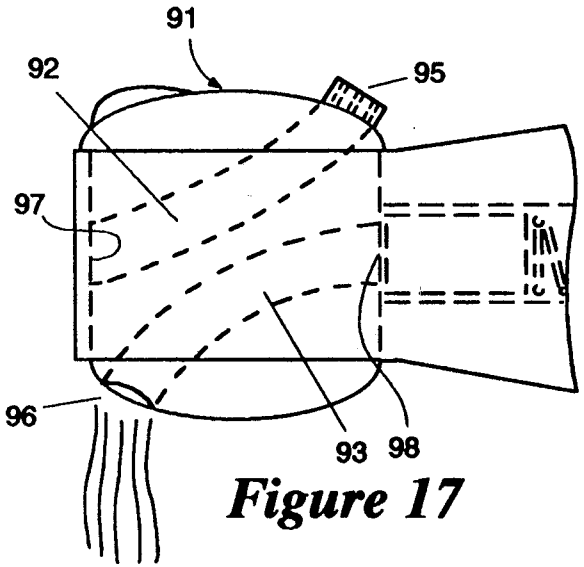

The head 91 is the diverter for this embodiment. FIG. 17 shows first and second channels 92 and 93 (shown in dashed lines) for directing the water out of a bidet spray outlet 95 or tub fill outlet 96, respectively. The channels 92 and 93 also include inlets 97 and 98, respectively, for alignment with bore 84 to allow water to flow through the head 91 and out of outlet 95 (as shown in FIG. 16) or outlet 96 (as shown in FIG. 17). The head further includes a handle 99 for manual rotation of the head to three distinct positions. A shoulder 100 of the head 91 extends out over the edge of hole 89 to support the head on the spout 81.

Figure 15:
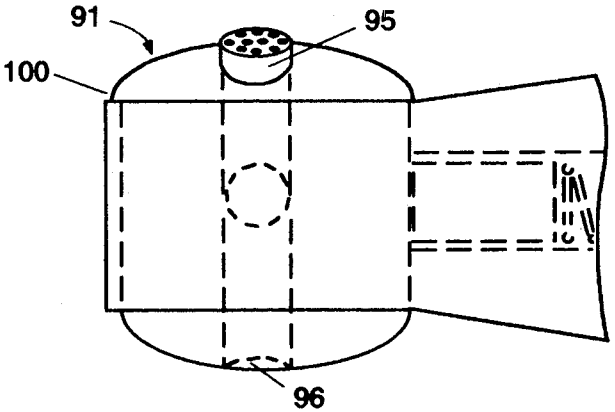

In operation, head 91 acts as a cylindrical diverter valve and rotates between three distinct positions within the spout 81 on a vertical axis as seen in FIGS. 15–17. The first position is shown in FIG. 15 and diverts all water to the shower head. In this position, neither inlet 97 nor inlet 98 is aligned with bore 84. Thus, water cannot flow any further through the spout and is consequently diverted to the shower. The second position is a bidet spray position shown in FIG. 16. When the head is rotated to this position, inlet 97 is aligned with spout bore 84 to allow water through channel 92 and out of the bidet spray nipple 95 as an upwardly directed fine spray. The third position is a tub fill position shown in FIG. 17. When the head is rotated to this position, inlet 98 is aligned with spout bore 84 to allow the water through channel 93 and out of the bathtub fill opening 96.

The combination spout of all four embodiments of FIGS. 1–5, 6–9, 10–13 and 14–17 have common advantages over the prior art cited within the background of the invention, above. Specifically all of the embodiments show a multi-purpose spout with a rotatable valve or diverter that diverts the flow of water to a shower head, bath tub, bidet spray, or douche hose. The tight tolerances within all four devices prevent the leakage of water through any flow path except the one selected by the diverter. The present invention is a unique device that solves many problems with conventional bath tub spouts and bidet spray devices.

It should be apparent that many modifications could be made to the combination spout which would still be encompassed within the spirit of the present invention. It is intended that all such modifications may fall within the scope of the appended claims.

What is claimed is:

1. A bath tub spout comprising:

an inlet channel, said inlet channel capable of being connected to a bath tub fill pipe;

a plurality of outlet channels within said spout;

a rotatable body for selectively directing water to one of said plurality of outlet channels within said spout, said body having a substantially cylindrical construction and is rotatable upon a central axis extending through said cylindrical body;

one of said plurality of outlet channels comprises an upwardly directed spout, said upwardly directed spout rigidly attached to said rotatable body;

wherein, said body may be rotated to a plurality of predetermined positions defining a plurality of paths for the flow of water through said plurality of outlet channels.

2. A spout as claimed in claim 1, wherein, one of said plurality of outlet channels causes the flow of water to be directed to a shower head.

3. A spout as claimed in claim 1, wherein, one of said plurality of outlet channels comprises a downwardly directed spout to cause the flow of water to be directed to fill a bath tub.

4. A spout as claimed in claim 1, wherein, said rotational axis of said body lies in a vertical line and is perpendicular to said longitudinal line of said water flow path.

5. A spout as claimed in claim 1, wherein, said rotational axis of said body lies in a horizontal line and is perpendicular to said longitudinal line of said water flow path.

6. A spout as claimed in claim 1, wherein, said rotational axis of said body lies along the same line of said longitudinal line of said water flow path.

* * * * *